US008162418B2

(12) United States Patent
Kocak et al.

(10) Patent No.: US 8,162,418 B2
(45) Date of Patent: Apr. 24, 2012

(54) DOOR FOR CLOSING A WASHING MACHINE OR A TUMBLE DRYER

(75) Inventors: Ahmet Kocak, Berlin (DE); Andreas Lange, Bad Salzuflen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 745 days.

(21) Appl. No.: 12/086,203

(22) PCT Filed: Nov. 22, 2006

(86) PCT No.: PCT/EP2006/068771

§ 371 (c)(1),
(2), (4) Date: Feb. 10, 2009

(87) PCT Pub. No.: WO2007/065793

PCT Pub. Date: Jun. 14, 2007

(65) Prior Publication Data

US 2009/0212677 A1 Aug. 27, 2009

(30) Foreign Application Priority Data

Dec. 9, 2005 (DE) ..... 10 2005 058 898

(51) Int. Cl.
*A47B 77/06* (2006.01)

(52) U.S. Cl. ..... 312/228; 312/329; 16/267; 16/389

(58) Field of Classification Search ..... 312/326–329, 312/228, 138.1; 16/267, 266, 389, 392; 68/196, 68/12.12; 134/200
See application file for complete search history.

(56) References Cited

U.S. PATENT DOCUMENTS

| | | | | |
|---|---|---|---|---|
| 2,131,802 | A * | 10/1938 | Harmon | 16/258 |
| 3,883,201 | A * | 5/1975 | Busoni | 49/167 |
| 6,938,444 | B2 * | 9/2005 | Hong et al. | 68/196 |
| 7,581,414 | B2 * | 9/2009 | Kim et al. | 68/196 |
| 7,617,570 | B2 * | 11/2009 | Hill | 16/347 |
| 7,761,958 | B2 * | 7/2010 | Alfredsson et al. | 16/267 |

(Continued)

FOREIGN PATENT DOCUMENTS

DE 40 40 291 6/1992

(Continued)

OTHER PUBLICATIONS

Internatiaonal Search Report PCT/EP2006/068771.

*Primary Examiner* — Darnell Jayne
*Assistant Examiner* — Daniel Rohrhoff
(74) *Attorney, Agent, or Firm* — James E. Howard; Andre Pallapies

(57) ABSTRACT

A door for closing a washing machine which can be loaded from the front or a tumble dryer of this type is connected to the housing by means of a hinge in such a way that the door can be pivoted over a great opening angle and terminates flushly or approximately flushly to the outside with the front face of the housing. To this end, the door-side hinge part is installed and fastened in a recessed receptacle between the frame parts and of the door. The hinge parts and each have a crescent-shaped base plate and which extends along the door frame and reaches beyond the lateral apertures and the bearing blocks which are provided in the frame.

28 Claims, 2 Drawing Sheets

U.S. PATENT DOCUMENTS

| | | | | |
|---|---|---|---|---|
| 7,934,404 | B2 * | 5/2011 | Ha | 68/196 |
| 2002/0078525 | A1 * | 6/2002 | Hua et al. | 16/221 |
| 2004/0083769 | A1 * | 5/2004 | Kim et al. | 68/12.02 |
| 2005/0017612 | A1 | 1/2005 | Park | |
| 2005/0262887 | A1 * | 12/2005 | Kim et al. | 68/196 |
| 2006/0156767 | A1 * | 7/2006 | Kim et al. | 68/175 |
| 2009/0212677 | A1 * | 8/2009 | Kocak et al. | 312/326 |
| 2010/0295428 | A1 * | 11/2010 | Favaro et al. | 312/228 |
| 2011/0025177 | A1 * | 2/2011 | Schone | 312/228 |

FOREIGN PATENT DOCUMENTS

| | | |
|---|---|---|
| GB | 2 360 297 | 9/2001 |
| WO | WO 03/004754 | 1/2003 |
| WO | WO 03/057971 | 7/2003 |

* cited by examiner

Fig. 2
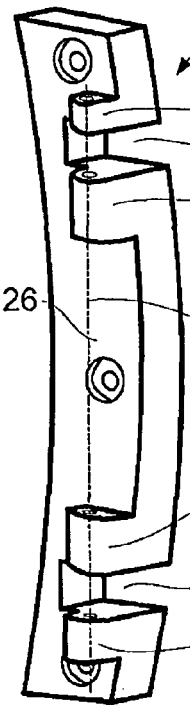
Fig. 4
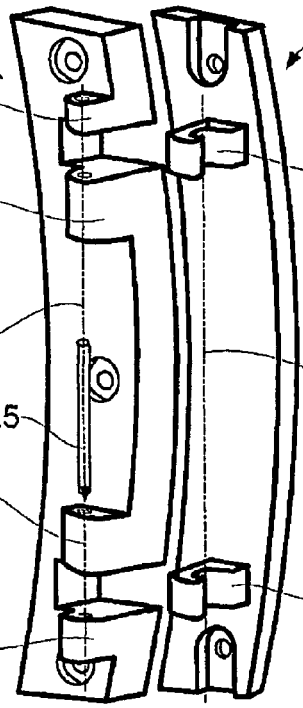
Fig. 3
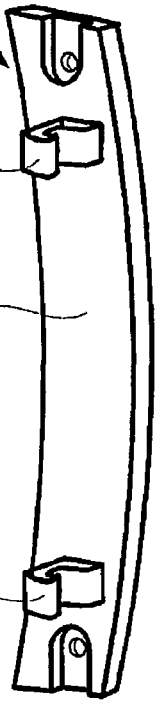
Fig. 6
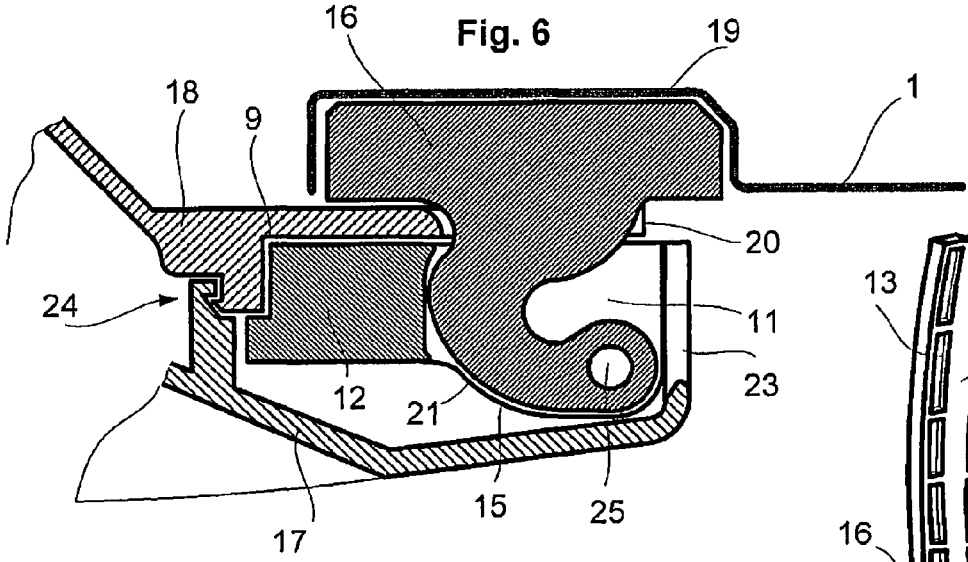
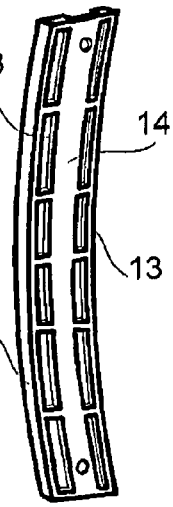
Fig. 5

DOOR FOR CLOSING A WASHING MACHINE OR A TUMBLE DRYER

BACKGROUND OF THE INVENTION

The invention relates to a door for closing a front-side loading opening in the housing of a washing machine or tumble dryer, wherein two door shells are connected by means of a hinge to the housing in such a way that the door can be pivoted through an opening angle of at least approximately 180° and in the closed position is countersunk in a front wall recess in such a way that it terminates flush or approximately flush with the front surface of the housing.

In a commercially available appliance of this kind, the door is fitted with a transparent cup-shaped window which is inserted between a retaining ring forming the inside of the door frame and a front-side panel frame and is mechanically firmly locked in position by the connection of the two frame parts. The stability of the door is substantially dependent on the frame which is made of plastic. The door is endowed with a necessary flexural and torsional rigidity due to the shape of the frame parts and due to reinforcing ribs and ridges recessed on the inside. The doors of the type that is of interest here are moved by hand. For this purpose they have a handle or a handle area which usually lies opposite a hinge or is disposed offset slightly upward opposite the horizontal center line.

The load acting on the hinge is determined on the one hand by the door's own weight and on the other hand by the force applied by the user when opening and closing the door. The hinge of a washing machine or tumble dryer is expected also to have sufficient stability in the event that the user leans slightly on the open door.

Customer wishes for the best possible view into the interior of the appliance and the most convenient access possible to the drum during the loading and unloading operation can only be met by a large door overall and a large transparent window mounted in the door frame. The mechanical loads acting on the hinge and its fixing to the door frame increase in proportion to the size of the door.

For reasons of design, in particular in the case of an appliance that is intended to be installed in a row of furniture units, it is advantageous if the door terminates flush with the front surface when in the closed position. The flush arrangement of the door can also be necessary for practical reasons. A door which because of its size extends close to the side edges of the appliance should not, or should only slightly, stick out from the plane of the appliance front in order to avoid abutting edges.

A front-flush door also affords advantages in the packaging of the appliance. Given housing dimensions that are otherwise the same, said packaging can be kept somewhat smaller and all precautionary measures to protect the projecting door separately can be dispensed with.

A hinge device for a door to be arranged flush into the front plane is known from DE 198 04 962 C1, for example. The solution described there is characterized by a particularly large swiveling angle of the door. Essential features of said hinge are a hinge strut and a control strut which are mounted with adjacent axes behind the front wall and project outward with a curved section through an opening in the front wall and are hinged with their outer ends to a door flange by means of two outer axes. When the door is opened, it is swiveled firstly about the inner axis and in the same direction of rotation about an outer axis. By means of such a hinge the door fitted flush in the front wall can be brought out from the plane of the front.

However, the manufacture of a hinge of this kind consisting of many individual parts is complicated and comparatively expensive. The two swivel axes make the hinge heavy and unstable and its fixing to the door requires a very stable frame due to the great weight. In particular with large and consequently heavier doors a significant amount of effort and expense is necessary in order to achieve the robustness necessary for such a hinge.

BRIEF SUMMARY OF THE INVENTION

The object of the invention is to disclose a solution that improves on the prior art for a door of the kind described in the introduction and for its hinge. The novel solution is intended to have an equally large opening angle using simpler means, to be stable, and to allow an economically more favorable manufacture overall.

The object is achieved according to the exemplary embodiments of the invention described herein.

The essential aspect of the door according to the invention is that the door is hinged to the housing by means of a single-axis hinge and a door-side hinge part is held between the front-side door shell and the housing-side door shell in a receptacle structure and the door-side hinge part has two apertures corresponding to edge slots in the housing-side door shell and bearing blocks associated therewith, the apertures serving to receive hinge arms arranged appropriately in terms of shape and position on the housing-side hinge part and projecting forward from the front wall recess. The housing-side hinge part is advantageously matched to the shape and geometry of the door frame and manufactured as a pressure die cast part, while the door-side hinge part can consist of a reinforced plastic.

By means of a hinge embodied in this way the forces acting thereon are absorbed over a large surface area and transferred into the stable frame areas and the lateral cutouts for the axle supports are also bridged, thereby avoiding an instability of the door frame in these areas. In spite of this arrangement that is suitable for a lightweight structure with few parts the door can be pivoted through approx. 180° in front of the front side of the housing, thus providing users of the washing machine or tumble dryer with the best possible access to the inside of the machine. The door-side hinge part rests flat directly against the inner surface of the load-carrying part of the door. The hinge axis is arranged close to the front plane, such that the pivotal point defined thereby allows a large pivoting range of the door in a simple manner.

According to an advantageous development of the invention, slots recessed in the front-side door shell in the edge facing the housing when the door is in the closed position correspond exactly in position to the apertures of the housing-side hinge part and to the edge slots of the housing-side door shell and encompass the hinge arms when the door is in the open position. The door-side hinge part forms an interference fit with the receptacle structure and is thereby held on the housing-side and/or front-side door shell. The interference fit of the hinge promotes the transmission of force into the frame.

These and further features of the exemplary embodiments can be combined with one another and with the features of other exemplary embodiments in any desired manner.

The hinge can be easily adapted to different appliance types and hence to the different loads acting on the hinge by suitable dimensioning of the hinge mount, i.e. by varying its width, strength and/or longitudinal extension along the door frame beyond the lateral apertures. The hinge according to the invention is therefore particularly suitable for use with large doors.

Compared to known hinges, the structural design of the hinge and its fixing in the door result in less severe requirements being placed on the stability of the door frame. The hinge according to the invention can therefore advantageously be used in particular for narrow frames and frames with a small depth.

The invention therefore represents a very economical solution overall. This relates both to the manufacture of the door frame and the hinge, as well as to its assembly and the necessary stability of the door frame.

BRIEF DESCRIPTION OF THE DRAWINGS

The invention is explained in more detail with the aid of an exemplary embodiment illustrated using a tumble dryer as an example and with reference to the accompanying drawings, in which:

FIG. 2 shows the door-side hinge part,

FIG. 3 shows the housing-side hinge part,

FIG. 4 shows both hinge parts shortly before the joining position,

FIG. 5 shows the housing-side hinge part from behind,

FIG. 6 shows a horizontal section through the joined hinge along the line of intersection VI-VI in FIG. 1.

DETAILED DESCRIPTION OF THE PRESENT INVENTION

Figure 1:
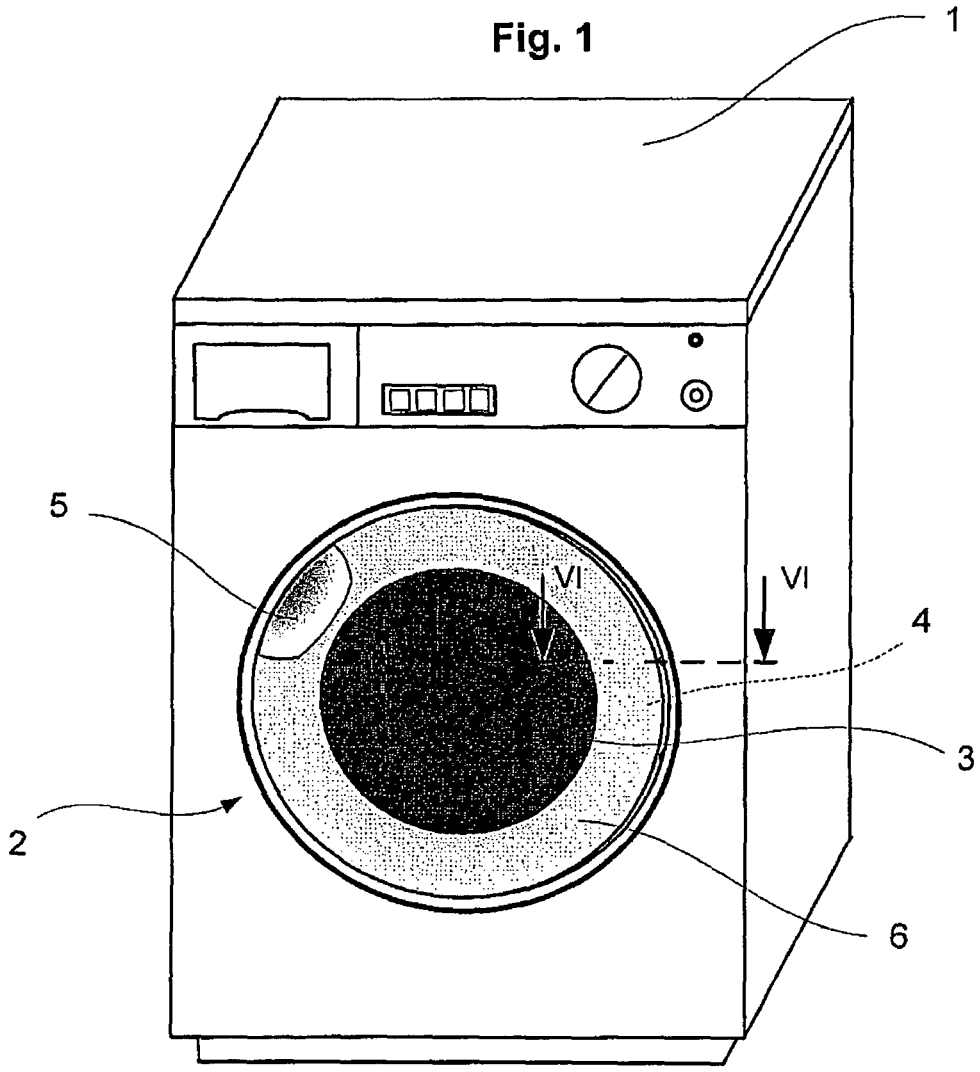
FIG. 1 shows a tumble dryer with a front-side loading opening

FIG. 1 shows the housing 1 of a tumble dryer which can be loaded from the front and has a door 2 which is pivotably hinged on one side. The door 2 for closing the loading opening consists of a two-part plastic frame 6 with recessed glass window 3. The door 2 is hinged to the appliance housing I by means of a hinge 4. Opposite the hinge 4, offset upward in the edge area of the frame 6, is an integrally formed door handle 5. When the door 2 is pivoted, the edge 22 dips behind the hinge arms (21, FIG. 6), such that the hinge arms 21 penetrate into slots 23 of the edge 22.

According to FIGS. 2 to 4, the hinge 4 consists of two parts, a door-side hinge part 12 and an appliance-side hinge part 16, which are connected to each other via only one axis of rotation 8. The axis of rotation 8 of the hinge 4 is split into two. The crescent-shaped base plate 26 of the door-side hinge part 12 spans the lateral apertures 11 (FIG. 7) in the door frame 6 which correspond to edge slots 20 of the housing-side door shell 18 between the bearing blocks 15. The crescent-shaped base plate 26 of the door-side hinge part 12 follows the shape of a circular arc which is matched to the curvature of the door frame 6 and has a flat bearing surface on the side toward the front-side door shell 17. In order to improve the integration into the door frame 6, the door-side hinge part 12 is recessed to fit exactly into the receptacle structure 9 incorporated in the frame part 6. The door-side hinge part 12 is additionally connected in a form-fit manner via screw bosses 10 to corresponding blind holes (not visible here) in the frame part 6 and secured by means of screws (not shown). The screw holes 7 serve to secure the housing-side door shell (not shown in FIG. 7).

The housing-side hinge part 16 is manufactured as a metal part using the pressure die casting method. Its crescent-shaped base plate 27 bears two hinge arms 21 through which the axis of rotation 8 penetrates. The hollow chambers 13 on its rear side (FIG. 5) serve to avoid accumulations of material and the corresponding separating webs 14 serve to stabilize the part. Even without such an illustration, however, the door-side hinge part 12 is structured in a similar way.

The joining-together of the hinge parts 12 and 16 is very simple. Toward that end, the housing-side hinge part 16 as shown in FIG. 4 is brought from behind toward the door-side hinge part 12 in such a way that the hinge arms 21 engage in the apertures 11 of the door-side hinge part 12 between the bearing blocks 15. As soon as the holes in the bearing blocks 15 and in the hinge arms 21 align with one another, a spindle 25 is driven into each of the holes adjoining one another.

Figure 7:
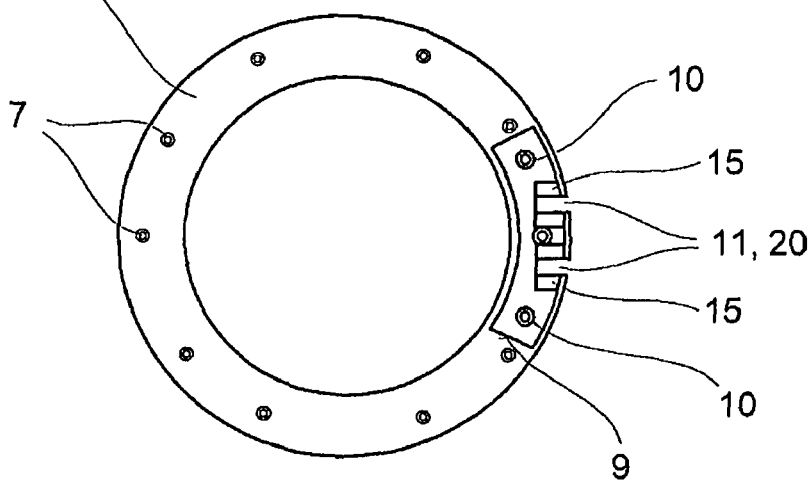
FIG. 7 shows a view onto the inside of the front-side door shell with assembled door-side hinge part.

The assembly of the hinge 4 is equally simple. For this purpose, the door-side hinge part 12 is inserted to fit exactly into the receptacle 9 of the housing-side door shell 18 (FIG. 6) and subsequently fixed there by means of a screw connection. In the exemplary embodiment a screw connection is provided between the lateral apertures 11 in the door frame 6 and one each is provided at the ends of the door-side hinge part 12 (FIG. 7). With larger doors 2 a higher number of screw connections is beneficial or, as the case may be, necessary. The screw connection secures the connection of hinge part 12 and door shell 18 and allows an interference fit with a close tolerance. The screw bosses 10 recessed in the door shell 18 are advantageously embodied as round and slightly conical and serve as positioning aids during assembly. Finally, the front-side door shell 17—that is the part of the door frame 6 that is visible externally—is reverse-drawn via the housing-side door shell connected to the hinge 4 and locked in place by means of the latching elements 24.

Reference Signs

1 Housing
2 Door
3 Glass window
4 Hinge
5 Door handle
6 Frame
7 Screw holes
8 Axis of rotation
9 Receptacle structure
10 Screw bosses
11 Aperture
12 Door-side hinge part
13 Hollow chambers
14 Separating webs
15 Bearing block
16 Housing-side hinge part
17 Front-side door shell
18 Housing-side door shell
19 Front wall recess
20 Edge slot
21 Hinge arm
22 Edge
23 Slot
24 Latching elements
25 Spindle
26 Crescent-shaped base plate (of 12)
27 Crescent-shaped base plate (of 16)

The invention claimed is:

1. An apparatus for closing a front-side loading opening in a housing of a washing machine or tumble dryer comprising:

a door, a housing, and a hinge; the housing having a front wall and a front wall recess; the door including a front-side door shell and a housing-side door shell; the housing-side door shell having edge slots;

the door being connected to the housing by the hinge in such a way that the door can be pivoted through an opening angle of at least approximately 180° and in a closed position is countersunk in the front wall recess of the housing in such a way that it terminates substantially flush with a front surface of the housing; and wherein the hinge is a single-axis hinge; the hinge including a door-side hinge part and a housing-side hinge part; the housing-side hinge part having hinge arms; the door-side hinge part being held between the front-side door shell and the housing-side door shell in a receptacle structure; the door-side hinge part having two apertures corresponding to the edge slots in the housing-side door shell and having associated bearing blocks; the apertures receiving the hinge arms and projecting forward from the front wall recess.

2. The apparatus as claimed in claim 1, wherein the housing-side hinge part is formed as a pressure die cast part.

3. The apparatus as claimed in claim 1, wherein the door-side hinge part is made from reinforced plastic.

4. The apparatus as claimed in claim 1, further including slots recessed in the front-side door shell in the edge facing the housing when the door is in the closed position; the slots corresponding in position to the apertures of the housing-side hinge part and to the edge slots of the housing-side door shell and receive the hinge arms when the door is in the open position.

5. The apparatus as claimed in claim 1, wherein the door-side hinge part forms an interference fit with the receptacle structure, whereby the door-side hinge part is held on the housing-side door shell.

6. The apparatus as claimed in claim 1, wherein the door-side hinge part forms an interference fit with the receptacle structure, whereby the door-side hinge part is held on the front-side door shell.

7. The apparatus as claimed in claim 1, wherein the housing-side door shell includes screw bosses; the door-side hinge part being screwed to the housing-side door shell via the screw bosses.

8. The apparatus as claimed in claim 7, wherein at least one screw boss is recessed on both sides of the edge slots of the housing-side door shell.

9. The apparatus as claimed in claim 7, wherein the screw bosses are positioning aids for screw connections.

10. The apparatus as claimed in claim 1 further including spindles; the hinge arms being rotatably mounted against the bearing blocks about the spindles.

11. The apparatus as claimed in claim 10, wherein the spindles are metal; the hinge arms being rotatably connected to the bearing blocks via one metal spindle for each hinge arm.

12. The apparatus as claimed in claim 1, wherein the door-side hinge part includes a crescent-shaped base plate; the apertures being at edges of an outside curve of the base plate; the bearing blocks rising up toward a front of the apertures.

13. The apparatus as claimed in claim 1, wherein the housing-side hinge part includes a crescent-shaped base plate; the two hinge arms corresponding to the apertures of the door-side hinge part extend toward a front-side of the base plate.

14. The apparatus as claimed in claim 12, wherein the crescent-shaped base plate includes a structure containing hollow chambers and separating webs.

15. The apparatus as claim in claim 13, wherein the crescent-shaped base plate includes a structure containing hollow chambers and separating webs.

16. The apparatus as claimed in claim 1, wherein the housing-side door shell includes the receptacle structure, and wherein the door-side hinge part forms an interference fit with the receptacle structure.

17. The apparatus as claimed in claim 16, wherein the receptacle structure is coupled to the housing-side door shell via screw connections.

18. The apparatus as claimed in claim 16, wherein the door-side hinge part includes a first crescent-shaped base plate, wherein edges of an outside curve of the crescent-shaped base plate include the apertures, and wherein the bearing blocks extend in a direction away from the housing-side door shell and toward the front-side door shell.

19. The apparatus as claimed in claim 1, wherein the front-side door shell includes the receptacle structure, and wherein the door-side hinge part forms an interference fit with the receptacle structure.

20. The apparatus as claimed in claim 19, wherein the receptacle structure is coupled to the front-side door shell via screw connections.

21. The apparatus as claimed in claim 1, wherein the door-side hinge part includes a first crescent-shaped base plate, wherein edges of an outside curve of the crescent-shaped base plate include the apertures, and wherein the bearing blocks extend in a direction away from the housing-side door shell and toward the front-side door shell.

22. The apparatus as claimed in claim 21, wherein the housing-side hinge part includes a second crescent-shaped base plate, wherein the hinge arms extend from the second crescent-shaped base plate in a direction away from the housing-side door shell and toward the front-side door shell.

23. The apparatus as claimed in claim 1, wherein the housing-side hinge part is a pressure die cast housing-side hinge part.

24. The apparatus as claimed in claim 1, wherein the door-side hinge part is a reinforced plastic door-side hinge part.

25. A household appliance comprising:

a housing having a front-side loading opening, the housing including a front wall and a front wall recess, a door for closing the front-side loading opening, the door including a front-side door shell and a housing-side door shell; and a two-part hinge that couples the door to the housing such that the door is pivotable through an opening angle of at least approximately 180° and in a closed position is countersunk in the front wall recess of the housing and terminates substantially flush with the front wall of the housing, the housing-side door shell having edge slots, the two-part hinge being a single-axis hinge, the two-part hinge including a door-side hinge part and a housing-side hinge part, the housing-side hinge part having hinge arms, one of the front-side door shell and the housing-side door shell including a receptacle structure, wherein the door-side hinge part is held between the front-side door shell and the housing-side door shell in the receptacle structure, the door-side hinge part having two apertures corresponding to the edge slots in the housing-side door shell, the door-side hinge part having associated bearing blocks, and the apertures receiving the hinge arms and projecting forward from the front wall recess.

26. The domestic appliance of claim 25, wherein the receptacle structure is coupled to the one of the housing-side door shell and the front-side door shell via screw connections.

27. The domestic appliance of claim 25, wherein the door-side hinge part includes a first crescent-shaped base plate, wherein edges of an outside curve of the crescent-shaped base plate include the apertures, and wherein the bearing blocks extend in a direction away from the housing-side door shell and toward the front-side door shell.

28. The domestic appliance of claim 27, wherein the housing-side hinge part includes a second crescent-shaped base plate, wherein the hinge arms extend from the second crescent-shaped base plate in a direction away from the housing-side door shell and toward the front-side door shell.

* * * * *